United States Patent [19]

Ito et al.

[11] 4,132,079

[45] Jan. 2, 1979

[54] APPARATUS FOR REMOTELY OPERATING SELF-ADVANCING SUPPORTS OR THE LIKE

[75] Inventors: Tsunetoshi Ito, Tokyo; Hideo Inoue, Yokohama, both of Japan

[73] Assignee: Taiheiyo Engineering Incorporated, Tokyo, Japan

[21] Appl. No.: 819,322

[22] Filed: Jul. 27, 1977

[30] Foreign Application Priority Data

Feb. 28, 1977 [JP] Japan ..... 52-21710

[51] Int. Cl.[2] ..... E21D 15/44

[52] U.S. Cl. ..... 405/299; 91/1; 405/302

[58] Field of Search ..... 61/45 D; 91/1, 189, 91/170 MP; 299/31

[56] References Cited

U.S. PATENT DOCUMENTS

| | | | |
|---|---|---|---|
| 3,495,499 | 2/1970 | Ward | 61/45 D |
| 3,821,880 | 7/1974 | Weirich | 61/45 D |
| 4,050,256 | 9/1977 | Phillips | 61/45 D |

FOREIGN PATENT DOCUMENTS

| | | | |
|---|---|---|---|
| 2212686 | 9/1973 | Fed. Rep. of Germany | 61/45 D |
| 1286814 | 8/1972 | United Kingdom | 61/45 D |

*Primary Examiner*—Jacob Shapiro

*Attorney, Agent, or Firm*—Frank J. Jordan

[57] ABSTRACT

Apparatus for remotely operating self-advancing supports or the like at a long-walled pit face of a coal mine comprises a receiver attached to every group of the supports which are arranged in front of and along the long-walled pit face, each of the receivers having a specific frequency, hydraulic cylinders attached to the support for causing the support to be operated, electromagnetic valves connected to the receiver to control the hydraulic cylinders, and a portable operating means including keys for specifying the groups of the supports, key switches for specifying the supports to be operated, and a transmitting circuit having operating switches, wherein operating signals are applied from the operating means via the radio system to the receivers.

9 Claims, 2 Drawing Figures

APPARATUS FOR REMOTELY OPERATING SELF-ADVANCING SUPPORTS OR THE LIKE

The present invention relates to an apparatus for remotely operating groups of self-advancing supports and a shearer-carrying conveyor, which are employed mainly at a long-walled pit face, especially in a coal mine of a thin coal bed. Conventionally, each self-advancing support belonging to any of the groups and the conveyor are watched and operated directly by an operator according to the movement of the shearer. Therefore, the operator must locate himself adjacent to the support to be operated, so that he is always in danger of impairing his health due to the inspiration of coal dust, or being injured by falling rocks in an accident. In case the ceiling of the pit face is very low, he is forced to take an extrmemely difficult posture so as to allow him to directly operate the support, thereby reducing the operation efficiency considerably.

The present invention is intended to eliminate the above-mentioned drawbacks.

It is, therefore, a primary object of the present invention to provide an apparatus for remotely operating each support belonging to any of the groups from a desired position remote from the support to be operated.

Another object of the present invention is to provide an apparatus for preventing a not-intended support to be operated by dividing the supports into groups so as to be easily controlled and operated.

These and other objects as well as the merits of the present invention will be apparent from the following detailed description with reference to the accompanying drawings.

Figure 1:
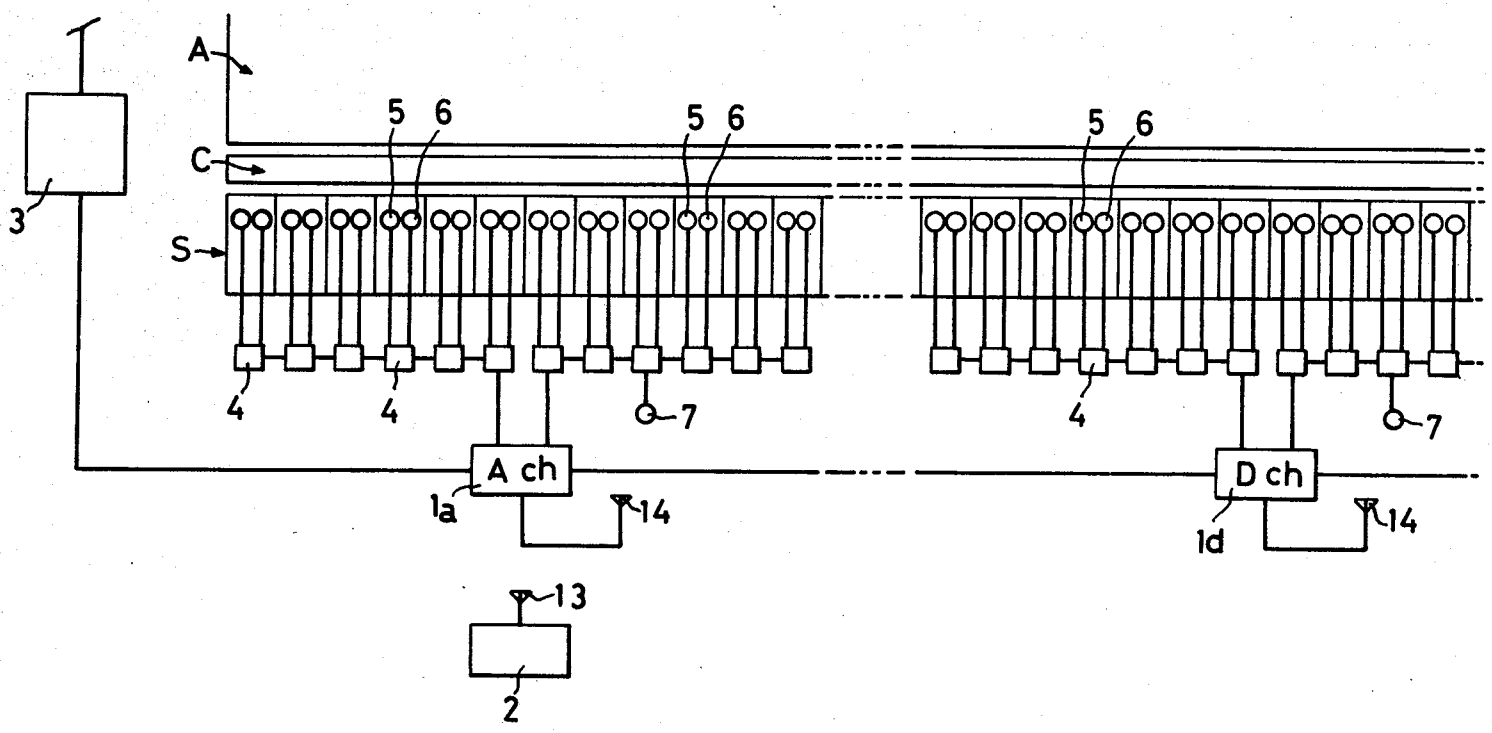
FIG. 1 is a block diagram showing an embodiment of the present invention.

In FIG. 1, symbol A represents a long-walled coal bed, C a shearer-carrying conveyor, S groups of self-advancing supports, 1*a* and 1*d* receivers, 2 a portable operating means, and 3 a current source. A group of self-advancing supports consists of from ten to twelve supports, which can be effectively controlled and operated by an operator within the scope of his sight. Every group of supports has a receiver 1*a*, 1*d*, - - -, *or 1n* so as to allow each of supports belonging to the group to be individually operated. To the receiver 1*a*, 1*d*, - - - or 1*n* are connected electromagnetic valves 5 and 6 through joint boxes 4. Each of the supports is generally provided with at least two kinds of hydraulic cylinders, one serving to support the roof beams of the pit face and the other to shift the support toward the pit face. In short, these two kinds of hydraulic cylinders enable the support to support the roof beams, to refrain from supporting the beams, and to be shifted toward the pit face. Accordingly, each of supports needs at least two electromagnetic valves 5 and 6, the electromagnetic valve 5, for example, working the hydraulic cylinder for causing the support to refrain from supporting the roof beams and to be shifted toward the pit face, and the electromagnetic valve 6 working the other hydraulic cylinder for causing the support to support the roof beams. To one of the supports belonging to every group is connected another electromagnetic valve 7, which controls another hydraulic cylinder for causing the conveyor C to be shifted toward the pit face.

Figure 2:
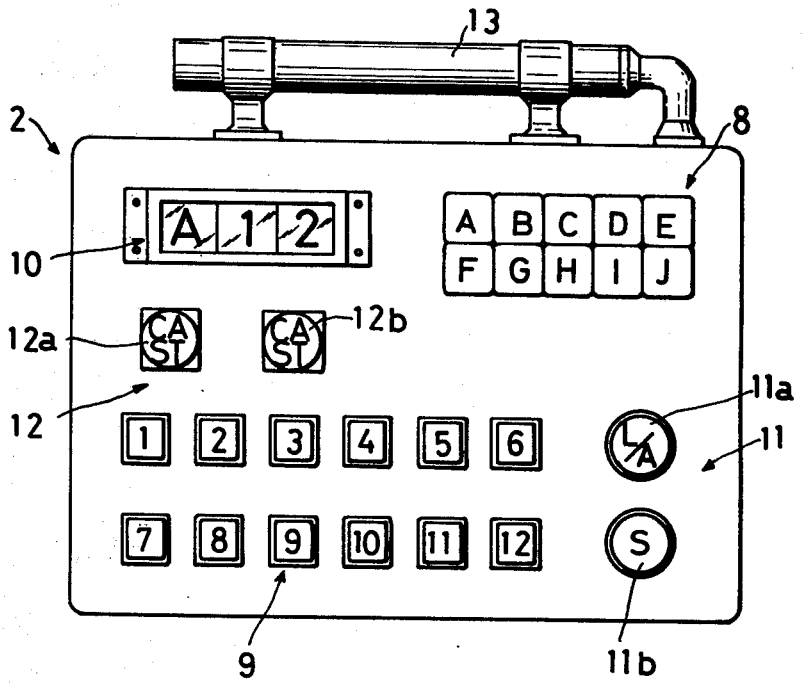
FIG. 2 is a front view showing a portable operating means.

Referring to FIG. 2, the operating means 2 is an airtight and portable radio transmitter provided with accessories. Numeral 8 represents a key board for specifying one of the groups which includes the support to be operated, 9 represents key switches for specifying the supports belonging to the group specified, 10 a digital display displaying the group and the support specified, 11 a support-operating switch section comprising a switch 11*a* for causing the support to refrain from supporting the roof beams and to be shifted toward the pit face, and a switch 11*b* for causing the support to support the roof beams, 12 a conveyor-shifting switch section comprising a start button 12*a* for starting the shift of the conveyor and a stop button 12*b* for stopping the shift of the conveyor, and 13 an antenna.

According to a group symbol previously designated to represent the group which includes the support to be operated, the operator pushes one of the keys arranged in the key board 8, and then pushes one of the key swithes 9 according to the number previously designated to represent the support to be operated. When one of the keys arranged in the key board 8 is pushed, an operating signal having a specific frequency is transmitted from the operating means and received by one of the receivers 1*a*, 1*d*, - - - and 1*n* shown in FIG. 1 and having a corresponding frequency. The operator makes sure at this stage that the group symbol and the number displayed by the digital display 10 are the same as those representing the group and the support to be operated. The group symbol and the number displayed by the digital display in FIG. 2 show that the twelfth support belonging to the group A has been specified. The operator then pushes the switch 11*a* or 11*b* arranged in the support-operating switch section 11. As the result, the electromagnetic valve 5 or 6 attached to the support to be operated is put in an "ON" condition to bring its corresponding hydraulic cylinder into movement, thereby causing the support to refrain from supporting the roof beams and to be shifted toward the pit face, or to again support the roof beams. When the switch 12*a* or 12*b* arranged in the conveyor-shifting switch section 12 is pushed, the shift of the conveyor is started or stopped. The operating signals are transmitted through the antenna 13 from the operating means 2 and received through antennas 14 by the receivers. However, since the operating signals carry a different specific frequency, respectively, according to the group and the support to be specified, only one receiver having a corresponding frequency is operated.

According to the apparatus of the present invention the operator can operate the supports keeping himself at a safe position and keeping the supports within his sight, thereby preventing any accident due to the wrong operation of the supports or the like.

It will be understood that the present invention includes the following modifications and variations within the scope of the invention.

(1) The antenna 14 for the receivers may extend as a long line along and parallel to the supports. Since each of The receivers has a predetermined specific frequency allotted, it is possible to specify any of the receivers without providing an antenna individually attached to each of the receivers. It is also possible to avoid the possibility that the receiving capability of the apparatus is lost due to the lack of power depending on the distance between the operating means 2 and the receiver 1.

(2) The transmission from the operating means 2 to the receiver 1*a*, 1*b* . . . 1*n* may be made through the radio inductive system.

(3) Each of the supports may be specified by a signal transmitted through the receiver 1*a*, 1*b* . . . 1*n*, the signal converter and matrix and logic circuits.

(4) Though the portable operating means 2 shown in FIG. 2 is placed into an "ON" or "OFF" condition by pushing one of the switches, it may be arranged that the wrong operation of the supports is surely avoided by inserting one of a plurality of keys into its corresponding one of a plurality of holes so as to render the operating means 2 operative, each of the keys having a specific configulation fittable into its corresponding hole provided in the key board. Or a magnetic key of specific shape may be used to put one of the contacts in an "ON" condition by the action of a magnet. Or the electromotive force of a piezoelectric element may be generated by the insertion of a special key to render the piezoelectric element operative. Or the operating means 2 may be rendered operative by means of electrostatic switches.

The present invention having such arrangement as described above allows the operator to easily and remotely operate any of the supports belonging to every group thereof keeping himself remote from the support to be operated, so that his health and safety can be protected from inhaling coal dust and from accidents like falling rocks. The present invention further allows the operator to easily operate the supports at a narrow space where the operation of the supports could not be carried out by conventional apparatus.

What is claimed is:

1. An apparatus for remotely operating self-advancing supports along a long-walled pit face of a coal mine, comprising hydraulic cylinders attached to said self-advancing supports for operating the self-advancing supports along said long-walled pit face, said self-advancing supports being divided into a plurality of groups with each group consisting of a plurality of self-advancing supports, a radio receiver means connected to each of said groups of self-advancing supports, each of said radio receiver means operating under a different specific frequency, electromagnetic valves connected to said receiver means and operable to actuate said hydraulic cylinders to thereby control said self-advancing supports, and a portable radio transmitter means located remotely from said receiver means for transmitting radio signals to said receiver means such that the receiver means effect actuation of said electromagnetic valves, said transmitter means comprising a plurality of manually operable key elements manually operable to select the particular group of self-advancing supports to be operated and to select the particular hydraulic cylinder of the group to be operated, said transmitter means further comprising manually operable switches to effect the desired actuation of the selected hydraulic cylinder, whereby operating radio signals are transmitted from the remotely located transmitter means to the selected receiver means and the latter effects the desired actuation of the selected hydraulic cylinder through said electromagnetic valves.

2. An apparatus for operating self-advancing supports or the like according to claim 1, wherein each self-advancing support comprises two hydraulic cylinders one of which supports roof beams and the other of which shifts the self-advancing support toward the pit face, said manually operable switches comprising a first pair of switches for operating said one hydraulic cylinder and another pair of switches for operating said other hydraulic cylinder.

3. An apparatus for operating self-advancing supports or the like according to claim 1 further comprising a digital display on said transmitting means for visually displaying and identifying the selected hydraulic cylinder to be actuated by said manually operable switches.

4. An apparatus for operating self-advancing supports or the like according to claim 1 further comprising antennas on each of said receiver means and on said transmitter means.

5. An apparatus for operating self-advancing supports or the like according to claim 1, wherein said manually operable key elements and said manually operable switches form a keyboard on said transmitter means.

6. An apparatus for remotely operating self-advancing supports or the like according to claim 1 wherein the receivers have a common cable for an antenna which is arranged along the long-walled pit face of the coal mine.

7. An apparatus for remotely operating self-advancing supports or the like according to claim 1 wherein transmission from the portable operating means to the receiver is made through a radio inductive system.

8. An apparatus for remotely operating self-advancing supports or the like according to claim 1 wherein each of the self-advancing supports is selected by a signal transmitted from the portable operating means through matrix circuits.

9. An apparatus for remotely operating self-advancing supports or the like according to claim 1 wherein the key elements of the portable operating means are operated by operation keys having a specific shape or function.

* * * * *